US010224675B2

(12) United States Patent
Lin

(10) Patent No.: US 10,224,675 B2
(45) Date of Patent: Mar. 5, 2019

(54) COMPENSATION STRUCTURE FOR CHARACTERISTICS OF NETWORK PLUG

(71) Applicant: Jyh Eng Technology Co., Ltd., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/587,596

(22) Filed: May 5, 2017

(65) Prior Publication Data

US 2018/0115113 A1 Apr. 26, 2018

(30) Foreign Application Priority Data

Oct. 21, 2016 (TW) ..... 105216049 U

(51) Int. Cl.

| | |
|---|---|
| ***H01R 24/64*** | (2011.01) |
| ***H01R 107/00*** | (2006.01) |
| ***H01R 13/506*** | (2006.01) |
| ***H01R 4/2429*** | (2018.01) |
| ***H01R 4/2433*** | (2018.01) |
| ***H01R 13/6473*** | (2011.01) |
| ***H01R 13/627*** | (2006.01) |

(52) U.S. Cl.

CPC ..... *H01R 13/6473* (2013.01); *H01R 4/2429* (2013.01); *H01R 13/506* (2013.01); *H01R 13/6272* (2013.01); *H01R 24/64* (2013.01); *H01R 4/2433* (2013.01); *H01R 2107/00* (2013.01)

(58) Field of Classification Search

CPC ..... H01R 13/6461; H01R 13/6466; H01R 13/6473; H01R 4/2429; H01R 24/64

See application file for complete search history.

(56) References Cited

U.S. PATENT DOCUMENTS

| | | | | |
|---|---|---|---|---|
| 3,398,232 A * | 8/1968 | Hoffman | H01R 23/68 | 174/254 |
| 4,054,350 A * | 10/1977 | Hardesty | H01R 13/58 | 439/418 |
| 4,601,530 A * | 7/1986 | Coldren | H01R 24/62 | 439/460 |
| 5,284,447 A * | 2/1994 | Kristiansen | H01R 4/2404 | 439/425 |
| 5,593,314 A * | 1/1997 | Lincoln | H01R 24/64 | 439/418 |
| 5,628,647 A | 5/1997 | Rohrbaugh et al. | | |

(Continued)

*Primary Examiner* — Edwin A. Leon
*Assistant Examiner* — Oscar C Jimenez
(74) *Attorney, Agent, or Firm* — Guice Patents PLLC

(57) ABSTRACT

A compensation structure for electrical characteristics of a network plug includes a base and an upper cover. The base and the upper cover form a plug main body. A cable is inserted into the plug main body. A circuit board is connected to the cable through a piercing terminal seat and a press plate. a plurality of compensation sheets disposed in rows on a front bottom of the circuit board, wherein at least one set of the compensation sheets have the same shape, the compensation sheets are plate-shaped and the shapes of the compensation sheets are determined by capacitances between the compensation sheets to compensate electrical characteristics of the network plug.

6 Claims, 5 Drawing Sheets

(56) References Cited

U.S. PATENT DOCUMENTS 5,967,828 A * 10/1999 Geurts ..... H01R 13/6464 439/418
5,989,071 A * 11/1999 Larsen ..... H01R 13/6467 439/418
5,993,236 A * 11/1999 Vanderhoof ..... H01R 13/6463 439/344
6,007,368 A 12/1999 Lorenz et al.
6,010,353 A * 1/2000 Ensz ..... H01R 24/64 439/395
6,017,240 A * 1/2000 Belopolsky ..... H01R 13/6461 439/418
6,113,400 A 9/2000 Martin et al.
6,116,943 A 9/2000 Ferrill et al.
6,238,231 B1 * 5/2001 Chapman ..... H01R 13/5829 439/395
6,276,954 B1 * 8/2001 Arnett ..... H01R 13/6467 439/417
6,409,544 B1 6/2002 Wu
7,540,789 B2 6/2009 Gerber et al.
7,857,635 B2 * 12/2010 Goodrich ..... H01R 4/2412 439/344
8,894,446 B2 * 11/2014 Feldner ..... H01R 12/727 439/676
9,601,886 B1 * 3/2017 Fransen ..... H01R 24/64
9,640,924 B2 * 5/2017 Stanislaw ..... H01R 24/64
9,722,359 B2 * 8/2017 Pepe ..... H01R 13/6461
9,799,982 B1 * 10/2017 Lin ..... H01R 13/506
2004/0115983 A1 * 6/2004 Liang ..... H01R 13/6461 439/344
2004/0235360 A1 * 11/2004 Takahashi ..... H01R 24/64 439/676
2005/0026463 A1 * 2/2005 Harris ..... H01R 12/7088 439/65
2006/0189215 A1 * 8/2006 Ellis ..... H01R 13/6477 439/676
2008/0050965 A1 * 2/2008 Szelag ..... H01R 4/2433 439/387
2010/0317230 A1 * 12/2010 Larsen ..... H01R 4/2429 439/620.22
2011/0256763 A1 * 10/2011 De Geest ..... H01R 12/724 439/607.01
2011/0300740 A1 * 12/2011 Schumann ..... H01R 13/502 439/452
2012/0100744 A1 * 4/2012 Bolouri-Saransar ..... H01R 13/6469 439/404
2012/0190248 A1 * 7/2012 Bopp ..... H01R 13/6466 439/676
2012/0225584 A1 * 9/2012 Larsen ..... H01R 4/2429 439/620.09
2013/0280962 A1 * 10/2013 Fransen ..... H01R 13/6461 439/668
2014/0162489 A1 * 6/2014 Ma ..... H01R 4/2433 439/389
2014/0187077 A1 * 7/2014 Bolouri-Saransar ..... H01R 13/6469 439/404
2014/0187090 A1 * 7/2014 Larsen ..... H01R 4/2429 439/620.22
2014/0248806 A1 * 9/2014 Bopp ..... H01R 13/6466 439/676
2014/0273595 A1 * 9/2014 Geniac ..... H01R 13/26 439/357
2015/0263466 A1 * 9/2015 Fransen ..... H01R 13/6461 439/607.05
2016/0049753 A1 * 2/2016 SooHoo ..... H01R 13/665 439/587
2016/0056597 A1 * 2/2016 Larsen ..... H01R 4/2429 439/391
2016/0204552 A1 * 7/2016 Bopp ..... H01R 13/6466 439/676
2016/0261081 A1 * 9/2016 Geniac ..... H01R 13/26
2016/0359275 A1 * 12/2016 Pepe ..... H01R 4/242
2017/0033503 A1 * 2/2017 Oberski ..... H01R 12/515
2017/0141521 A1 * 5/2017 Bolouri-Saransar ..... H01R 13/6469
2018/0040987 A1 * 2/2018 Marowsky ..... H01R 13/6466
2018/0109038 A1 * 4/2018 Valenti ..... H01R 13/6461

* cited by examiner

COMPENSATION STRUCTURE FOR CHARACTERISTICS OF NETWORK PLUG

BACKGROUND OF THE INVENTION

Field of the Invention

The invention relates to a structure of a network plug, and more particularly to a compensation structure for electrical characteristics of a network plug without complicated metal sheets and circuits that are difficultly formed on PCB.

Description of the Related Art

A network cable usually includes eight core wires internally. The network cable is configured to extend through a jacket to enter a network plug. The core wires are peeled and electrically connected to piercing terminals in the network plug. The network plug can be inserted into a network socket. Each piercing terminal contacts a corresponding terminal in the socket for transmitting signals through the core wires. Every two core wires of the eight core wires are twisted together to form four pairs of twisted core wires. The first core wire and the second core wire form a twist pair, the third core wire and the sixth core wire form a twist pair, the fourth core wire and the fifth core wire form a twist pair, and the seventh core wire and the eighth core wire form a twist pair. When data (signals) are transmitted in the network, an electromagnetic effect (field) is generated around the core wire. When two core wire are disposed side-by-side, interference may occur between two adjacent core wires except that complementary effect occurs between the adjacent first and second core wires, the adjacent third and sixth core wires, the adjacent fourth and fifth core wires and the adjacent seventh and eight core wires. The interference may affects the transmission in a pair of adjacent piercing terminals configured to be connected to a network socket, especially for the piercing terminals connected to the twist pair of the fourth and fifth core wires, and they may be affected by the interference occurred between the third core wire and the fourth core wire and the interference occurred between the fifth core wire and the sixth core wire to have larger crosstalk and influence the quality of signals when the network plug is connected to a high frequency network.

The network cable includes four pairs of twisted core wires, and the first pair includes a white-orange core wire and an orange core wire, the second pair includes a white-green core wire and a green core wire, the third pair includes a white-blue core wire and a blue core wire, and the fourth pair includes a white-brown core wire and a brown core wire. The wiring of the cable follows T568A or T568B wiring scheme, and the core wires are arranged in an order as follows, white-orange, orange, white-green, blue, white-blue, green, white-brown and brown. The second pair core wires and the third pair core wires are not arranged as the T568A or T568B wiring scheme. This is the reason that crosstalk occurs.

There are eight metal sheets disposed at a tip of the network plug, and the core wires are connected to the metal sheets when the core wires are mounted into the network plug. Because the core wires are arranged side-by-side and the second pair of twisted core wire and the third pair of twisted core wires are not follow the wire scheme, the electrical characteristic is reduced. There are many compensation method for electrical characteristics disclosed by U.S. Pat. Nos. 5,628,647 or 6,409,544 to crosses the twisted pair or separate the second pair of twisted core wires from other wire pairs.

In addition, U.S. Pat. Nos. 7,540,789 and 6,007,368 disclose another compensation methods using the metal sheets of different shapes. U.S. Pat. Nos. 6,116,943 and 6,113,400 disclose compensation methods using circuits on a printed circuit board.

Although the patents mentioned above disclose compensation methods for the wire pairs, the metal sheets have complicated shapes as disclosed in U.S. Pat. No. 6,007,368. The compensation method using printed circuit board may causes over-intensive circuits on the printed circuit board and result in manufacturing problems.

BRIEF SUMMARY OF THE INVENTION

The invention provides compensation structure for a network plug performing compensation for electrical characteristic without using compensation sheet of complicated shape and the over-intensive circuits which are difficult to be formed on a printed circuit board.

The compensation structure in accordance with an exemplary embodiment of the invention includes a base having an upper end and a front seat; an upper cover having an end pivoted to the upper end and assembled with the base to form a main body; a network cable comprising a plurality of core wires, wherein a front portion of the network cable is inserted into the main body; a base plate mounted to the base, wherein the base plate positions a circuit board; a piercing terminal seat is disposed on the circuit board; a press plate are disposed above the circuit board; a lead seat mounted to the rear end to position the front portion of the network cable; a releasing spring sheet disposed on the front seat; and a plurality of compensation sheets disposed in rows on a front bottom of the circuit board, wherein at least one set of the compensation sheets have an identical shape, the compensation sheets are plate-shaped and have shapes determined by capacitances between the compensation sheets to compensate electrical characteristics of the network plug.

In another exemplary embodiment, the capacitance between the compensation sheets is governed by the following equation:

$$C = \varepsilon_r \varepsilon_o \frac{A}{d}$$

which determines a capacitance value for electrical characteristics compensation, wherein C means capacitance, $\in_r$ means dielectric constant between the compensation sheets, $\in_o$ means vacuum dielectric constant between the compensation sheets, A means a coupling area between the compensation sheets and d means a distance between the compensation sheets.

In yet another exemplary embodiment, an inductance between the compensation sheets is governed by the following equation:

$$M = \frac{\alpha l^2}{d},$$

wherein M means inductance correlation between the compensation sheets, l means a length of the compensation sheets and d means a distance between the compensation sheets.

In another exemplary embodiment, the compensation sheets have two inserts protruding from two sides with respect to a center of the compensation sheets and having a planar area for electrical characteristics compensation.

In yet another exemplary embodiment, the compensation sheets have one central insert having a planar area for electrical characteristics compensation.

In another exemplary embodiment, two of the compensation sheets which are adjacent have the same shape to obtain a first capacitance value for electrical characteristics compensation.

In yet another exemplary embodiment, two of the compensation sheets which are adjacent have different shapes to obtain a second capacitance value for electrical characteristics compensation.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
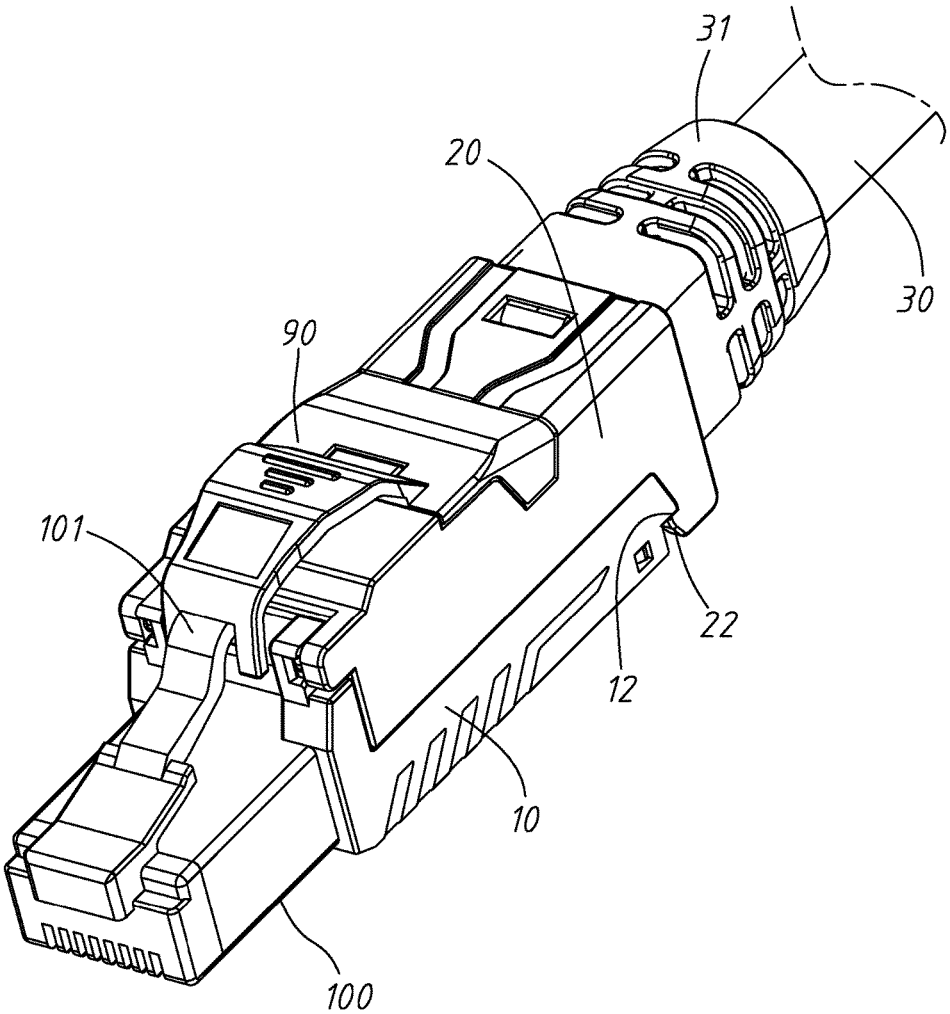
FIG. 1 depicts a perspective view of an embodiment of a compensation structure for electrical characteristics of a network plug of the invention.
Figure 2:
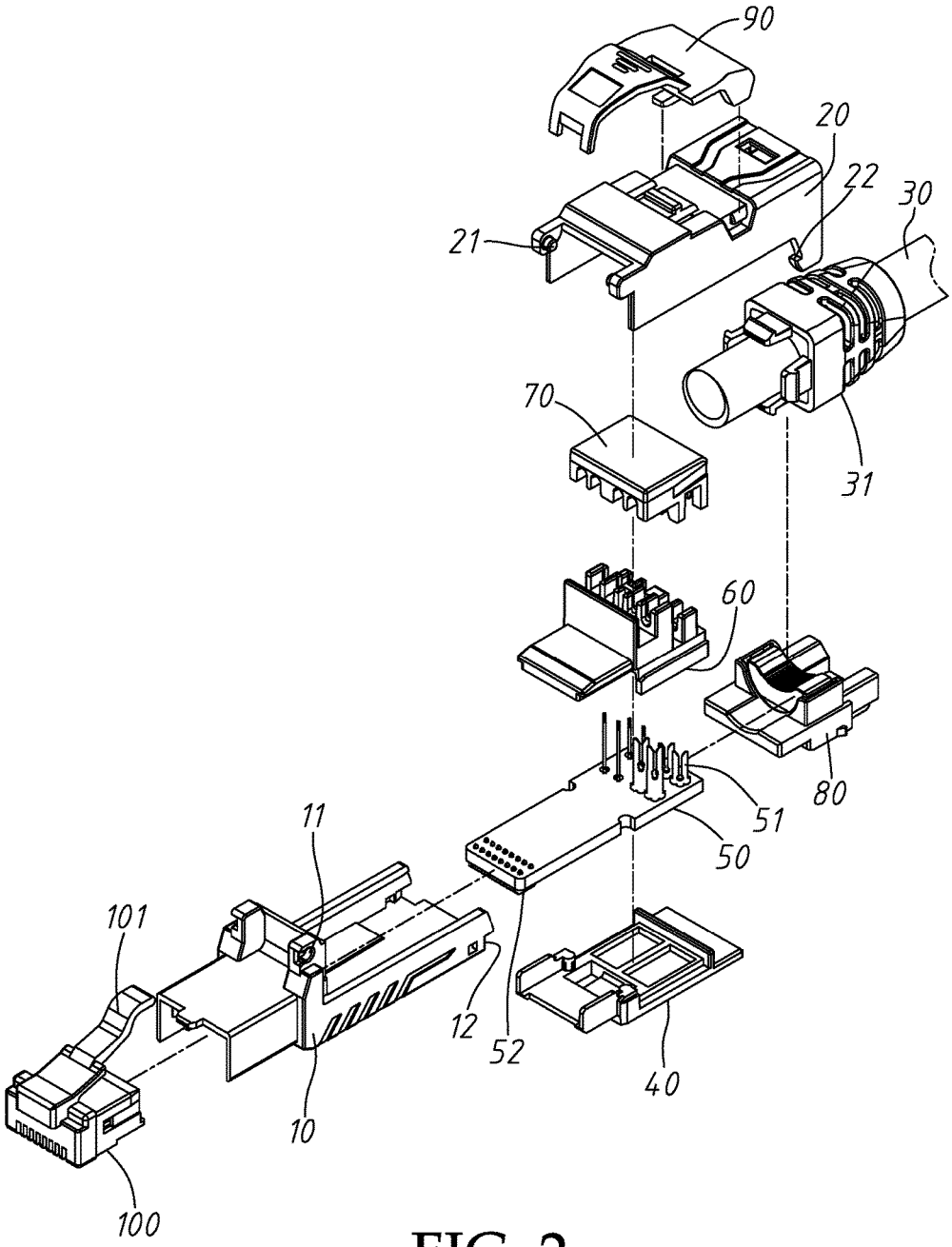
FIG. 2 is an exploded view of FIG. 1.

The following description is of the best-contemplated mode of carrying out the invention. This description is made for the purpose of illustrating the general principles of the invention and should not be taken in a limiting sense. The scope of the invention is best determined by reference to the appended claims.

Referring to FIGS. 1 to 4, a network plug of the invention includes a base 10 and an upper cover 20 having an end pivoted to an upper end of the base 10. The upper cover 20 and the base 10 form a main body of the network plug. A network cable 30 extends through a jacket 31, and a front portion of the network cable 30 is inserted into the main body. A base plate 40 is mounted to an inner surface of the base 10, and a circuit board (PCB) 50 is positioned on the base plate 40. A piercing terminal seat 60 is disposed on the circuit board 50, and a press plate 70 is disposed above the piercing terminal seat 60. A lead seat 80 is mounted to a rear end of the base 10 to position the front portion of the network cable 30. A releasing spring sheet 90 is disposed on the upper cover 20. A front base 100 corresponding to the releasing spring sheet 90 is disposed on the base 10. An unlock spring sheet 101 is disposed on the front base 100 and faces the releasing spring sheet 90. In another embodiment, the unlock spring sheet 101 is mounted to front base 100 directly to release the insertion of the network plug without using the releasing spring sheet 90.

The upper cover 20 includes two pivot portions 21 pivoted to two pivot seats 11 of the base 10. The upper cover 20 can be lifted or closed with respect to the pivot portions 21 and the pivot seats 11. The upper cover 20 further includes a middle plate 13 disposed between the pivot seats 11. The upper cover 20 has hooks 22 engaging notches 12 of the base 10. The network cable 30 includes eight core wires (not shown) connected to related elements in the main body.

Figure 3:
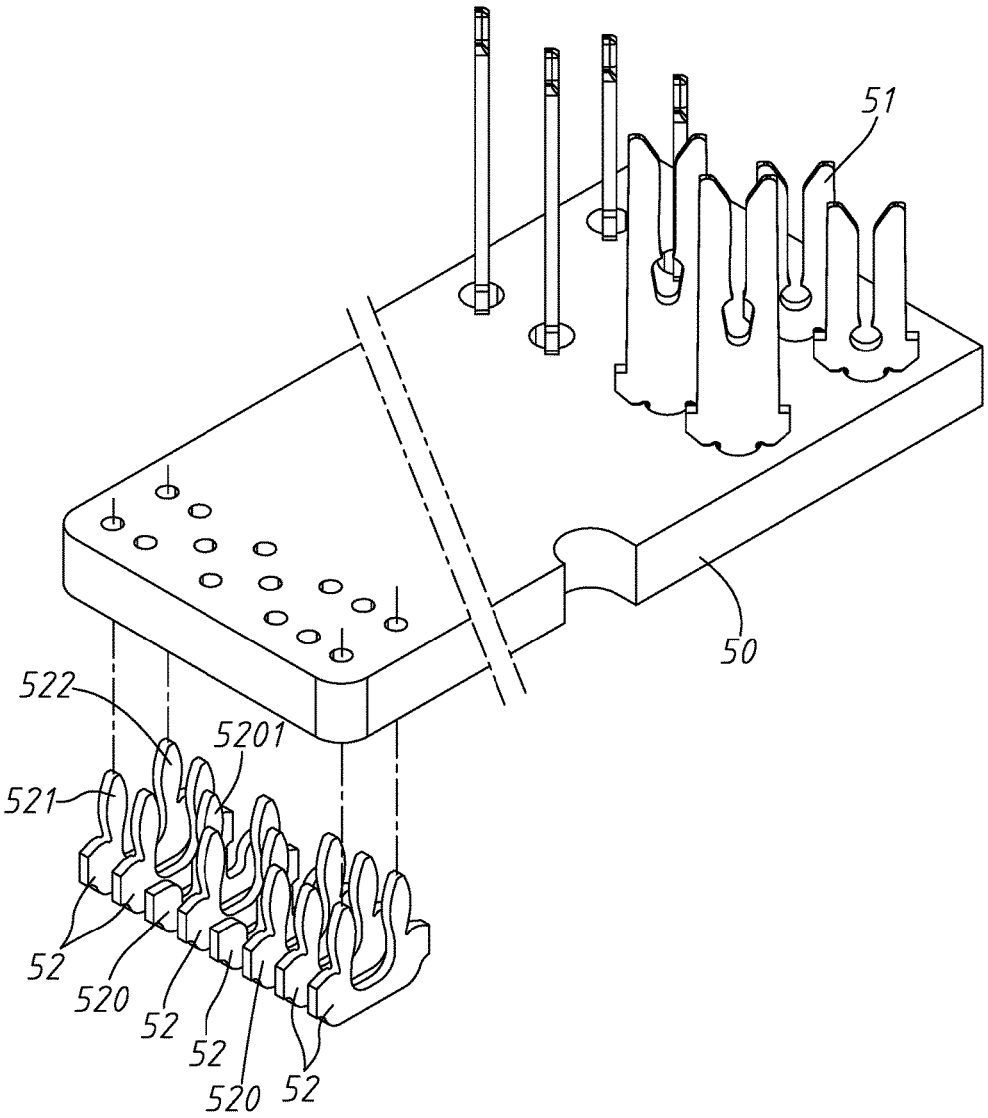
FIG. 3 is an enlarged view of a circuit board of FIG. 2, wherein compensation sheets and the circuit board are separated.
Figure 4:
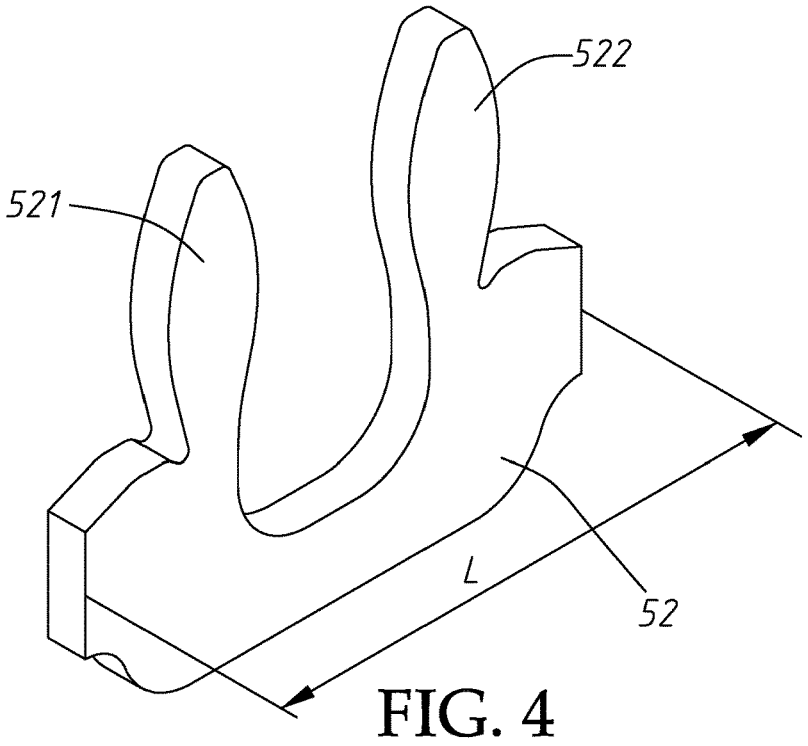
FIG. 4 is a perspective view of an embodiment of a compensation sheet of the invention.
Figure 5:
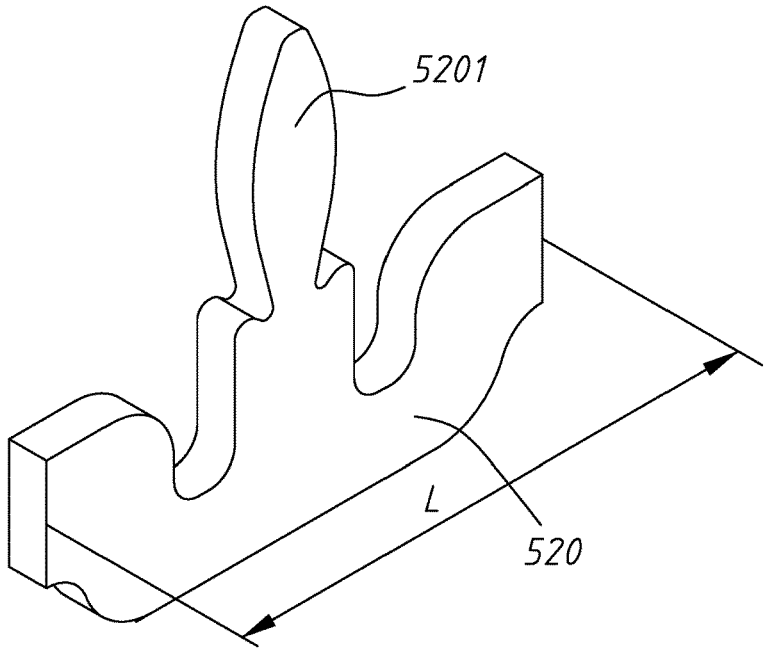
FIG. 5 is a perspective view of another embodiment of a compensation sheet of the invention.
Figure 6:
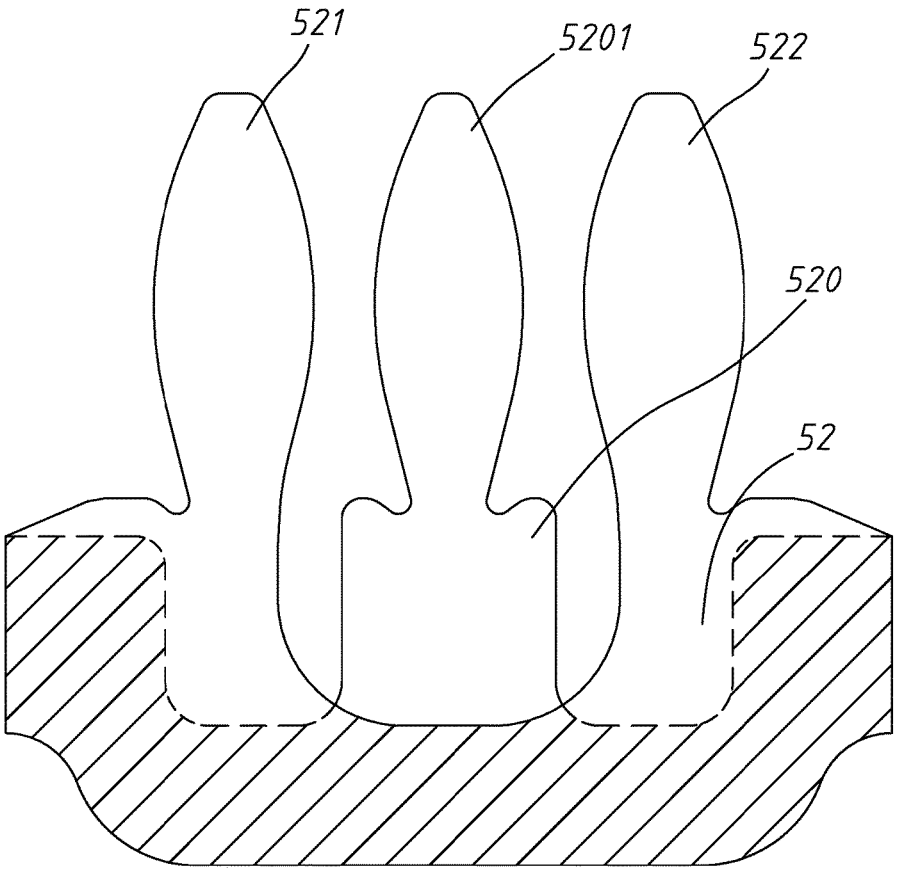
FIG. 6 depicts the compensation sheet of FIG. 4 and the compensation sheet of FIG. 5 alternately arranged.

Several piercing terminals 51 are disposed on an upper surface of the circuit board 50 cooperated with the piercing terminal seat 60 and the press plate 70 to pierce the core wires of the cable 30. As shown in FIG. 3A, a row of compensation sheets 52 is disposed on a bottom surface of the circuit board 50. At least one set of the compensation sheets 52 has an identical shape. There are eight compensation sheets including two sets compensation sheets 52 having the same shape (the set of the first compensation sheet and the second compensation sheets 52 and the set of the seventh compensation sheet and the eighth compensation sheets 52) and two sets of compensation sheets 520 having different shapes (the set of the third compensation sheet and the fourth compensation sheets 520 and the set of the fifth compensation sheet and the sixth compensation sheets 520). As shown in FIG. 4, in an embodiment, the compensation sheet 52 is plate-shaped and has two inserts 521 and 522 protruding from two sides with respect to a center of the compensation sheet 52. The inserts 521 and 522 have a planar area for electrical characteristics compensation. In another embodiment shown in FIG. 5, the compensation sheet 520 is plate-shaped and has one central insert 5201 having a planar area for electrical characteristics compensation. The type and the shape of the compensation sheet 52 and the compensation sheet 520 are determined by capacitance between two adjacent compensation sheets. The capacitance between two adjacent compensation sheets is governed by the following equation:

$$C = \varepsilon_r \varepsilon_o \frac{A}{d},$$

wherein C means capacitance, $\in_r$ means dielectric constant between the compensation sheets, $\in_o$ means vacuum dielectric constant between the compensation sheets, A means a coupling area between the compensation sheets and d means a distance between the compensation sheets. The electrical characteristics compensation can be performed by an arrangement of compensation sheets 52 and 520. The inductance correlation between two adjacent compensation sheets is governed by the following equation: equation:

$$M = \frac{\alpha l^2}{d},$$

wherein M means inductance correlation between the compensation sheets, l means a length of the compensation sheets and d means a distance between the compensation sheets. The signals transmitted in the twisted core wires of a wire pair are designed to be complementary in the inherent design of a network plug, and therefore the noises of the twisted core wires of the same wire pair are mutually balanced when the signals are transmitted in the cable. Because the metal sheet at the tip of the network plug must be arranged according to the sequence from the core wire 1 to the core wire 8. However, since the core wire 3 and the core wire 4 belong to different wire pair, and the core wire 5 and core wire 6 also belong to different wire pair, the noises between the mentioned two sets of core wires may be increased when signals are transmitted in the core wires. According to IEC 60603-7, the distance between the metal sheets in the inherent design of the network plug is 1.02 mm, and the value of $\in_r$ is 3, and $\in_o$ is 0.008854 ρF/mm. The capacitance between the core wire 3 and the core wire 4 is 0.2255 ρF, and the capacitance between the core wire 5 and the core wire 6 is also 0.2255 ρF. The necessary capacitance compensation is about 0.112 ρF. In the design of the network plug of the invention, the compensation sheets 52 and 520 connected between the core wires 3 and the core wire 4 and between the core wires 5 and the core wire 6 are arranged as shown in FIG. 6, and the coupling area of the compensation sheets 52 and 520 is greatly reduced, whereby the necessary capacitance compensation is thus reduced to 0.03 ρF and the inductance between the compensation sheets remains roughly the same.

The capacitance can be regulated through the arrangement of compensation sheets 52 and 520 of the same shape or different shape, whereby the electrical characteristics are compensated. In general, the compensation sheets of the same shape are used in a position needed more capacitance compensation such as the position between core wires 3 and the core wire 4 or between the core wires 5 and the core wire 6. The compensation sheets of different shapes are used in a position needed less capacitance compensation, such as the embodiment as shown in FIGS. 3 and 6, wherein two different compensation sheets 52 and 520 are used to reduce the interference between two metal sheets and regulate the compensation for capacitance.

The invention provides a network plug performing compensation for electrical characteristic without using compensation sheet of complicated shape and the over-intensive circuits which are difficult to be formed on a printed circuit board.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A compensation structure for electrical characteristics of a network plug, comprising:

a base having an upper end and a front seat;

an upper cover having an end pivoted to the upper end and assembled with the base to form a main body;

a network cable comprising a plurality of core wires, wherein a front portion of the network cable is inserted into the main body;

a base plate mounted to the base, wherein the base plate positions a circuit board;

a piercing terminal seat is disposed on the circuit board;

a press plate is disposed above the circuit board;

a lead seat mounted to the rear end to position the front portion of the network cable;

a releasing spring sheet disposed on the front seat; and a plurality of compensation sheets disposed in rows on a front bottom of the circuit board and being inserted into the circuit board, wherein at least one set of the compensation sheets have an identical shape, the compensation sheets are plate-shaped and have shapes determined by capacitances between the compensation sheets to compensate electrical characteristics of the network plug;

wherein the plurality of compensation sheets include single insert compensation sheets and double insert compensation sheets, the double insert compensation sheets have two inserts protruding upwardly in a same direction from two sides with respect to a center of the double insert compensation sheets and each of the two inserts having a planar area for electrical characteristics compensation, the single insert compensation sheets have one central insert having a planar area for electrical characteristics compensation;

wherein the planar area of each of the two inserts of the double insert compensation sheets and the central insert of the single insert compensation sheets protrude upwardly in the same direction.

2. The compensation structure as claimed in claim 1, wherein the capacitance between the compensation sheets is governed by the following equation:

$$C = \varepsilon_r \varepsilon_o \frac{A}{d}$$

which determines a capacitance value for electrical characteristics compensation, wherein C means capacitance, $\in_r$ means dielectric constant between the compensation sheets, $\in_o$ means vacuum dielectric constant between the compensation sheets, A means a coupling area between the compensation sheets and d means a distance between the compensation sheets.

3. The compensation structure as claimed in claim 2, wherein an inductance correlation between the compensation sheets is governed by the following equation:

$$M = \frac{\alpha l^2}{d},$$

wherein M means the inductance correlation between the compensation sheets, l means a length of the compensation sheets and d means a distance between the compensation sheets.

4. The compensation structure as claimed in claim 1, wherein an inductance correlation between the compensation sheets is governed by the following equation:

$$M = \frac{\alpha l^2}{d},$$

wherein M means the inductance correlation between the compensation sheets, l means a length of the compensation sheets and d means a distance between the compensation sheets.

5. The compensation structure as claimed in claim 1, wherein two of the compensation sheets, which are adjacent, have the same shape to obtain a first capacitance value for electrical characteristics compensation.

6. The compensation structure as claimed in claim 1, wherein two of the compensation sheets, which are adjacent, have different shapes to obtain a second capacitance value for electrical characteristics compensation.

* * * * *